US006614333B1

(12) United States Patent
Zimmermann

(10) Patent No.: US 6,614,333 B1
(45) Date of Patent: Sep. 2, 2003

(54) AUXILIARY SWITCH BLOCK

(75) Inventor: Norbert Zimmermann, Sulzbach-Rosenberg (DE)

(73) Assignee: Siemens AG, Munich (DE)

( * ) Notice: Subject to any disclaimer, the term of this patent is extended or adjusted under 35 U.S.C. 154(b) by 508 days.

(21) Appl. No.: 09/171,769

(22) PCT Filed: Apr. 28, 1997

(86) PCT No.: PCT/DE97/00870

§ 371 (c)(1),
(2), (4) Date: Oct. 26, 1998

(87) PCT Pub. No.: WO97/41584

PCT Pub. Date: Nov. 6, 1997

(30) Foreign Application Priority Data

Apr. 29, 1996 (DE) ..... 196 17 135

(51) Int. Cl.[7] ..... H01H 67/02
(52) U.S. Cl. ..... 335/132; 335/202
(58) Field of Search ..... 335/132, 133, 335/202, 126

(56) References Cited

U.S. PATENT DOCUMENTS

| | | | | | |
|---|---|---|---|---|---|
| 3,942,143 | A | * | 3/1976 | Pollmann et al. | 335/132 |
| 4,087,770 | A | * | 5/1978 | Kuhn et al. | 335/132 |
| 4,485,365 | A | | 11/1984 | Lerude et al. | |
| 4,774,484 | A | | 9/1988 | Lehman et al. | |
| 5,717,370 | A | * | 2/1998 | Haas | 335/132 |

FOREIGN PATENT DOCUMENTS

| | | |
|---|---|---|
| DE | 21 49 365 | 4/1972 |
| EP | 045 683 | 2/1982 |
| EP | 086 698 | 8/1983 |

* cited by examiner

*Primary Examiner*—Lincoln Donovan
(74) *Attorney, Agent, or Firm*—Kenyon & Kenyon

(57) ABSTRACT

An auxiliary switch block is provided for attachment to a basic device, while maintaining forcible guidance. The contact carrier of the auxiliary switch block is supported by guide means.

4 Claims, 2 Drawing Sheets

AUXILIARY SWITCH BLOCK

FIELD OF THE INVENTION

The present invention relates to an auxiliary switch block for attachment to a basic device, in particular a contactor.

BACKGROUND INFORMATION

A generic auxiliary switch block is obtainable on the electrical market. Auxiliary switch blocks of this type, as well as the basic devices, are provided with normally-closed and normally-open contacts.

Satisfactory normally-closed and normally-open functioning presupposes forcible guidance of the auxiliary switch block in relation to the basic device. This is ensured if, in the event of welding of a normally-closed contact in the auxiliary switch block, there is still an air gap of at least 0.5 mm at the normally-open contacts of the basic device.

Maintaining forcible guidance within a device, that is to say within an auxiliary switch block or a basic device, normally does not represent a problem. If the basic device and the auxiliary switch block are accommodated in a common housing, the coupling tolerances that occur here can be eliminated, and the forcible guidance can also be ensured here. However, the forcible guidance is made more difficult if an auxiliary switch block is subsequently attached to a basic device, as is illustrated in FIG. 2. In this case, the difficulty with the forcible guidance results from the fact that the contact carrier is guided only by relatively closely adjacent points of contact in the region of the interrupter chamber (see FIG. 3), which can result in a correspondingly exaggerated oblique position of the contact carrier. This tilted position can be transmitted to the coupled contact-piece carrier of the basic device and, in the event of welding of a normally-closed contact, together with the coupling tolerances of the auxiliary switch block in relation to the basic device, may result in an inadequately large air gap at one of the normally-open contacts.

European Patent No. 045 683 describes a single-pole auxiliary switch that can be coupled to a contactor. The contact carrier (of elongate design) of the auxiliary switch carries only a single contact piece, and is movably guided in an interrupter chamber. Here, the aim of guiding the contact-bridge carrier is merely the movement of the contacts between the open and closed positions. Because of the single-pole design, however, it is not necessary here to have any additional forcible guidance, such as is needed for a plurality of contact pieces which are located alongside one another under unfavorable conditions.

SUMMARY OF THE INVENTION

An object of the present invention is to improve an auxiliary switch block to the effect that the necessary forcible guidance is achieved.

According to the present invention, the object is achieved in that the contact carrier is provided, opposite the coupling point, with an extension which extends over the entire height of said carrier, reaches into a region of the interrupter chamber projecting beyond the contact carrier, and engages with guide means of the interrupter chamber in this region.

The auxiliary switching block has, on a side by which it is attached, a coupling point to engage with a contact carrier of the basic device, and has two rows of windows which are located one above another and each of which, in operation, is occupied by a contact piece only in the upper or lower window, depending on the design as a normally-closed or normally-open function, the height of the contact carrier essentially corresponding to the height of the pairs of windows.

DETAILED DESCRIPTION

Figure 1:
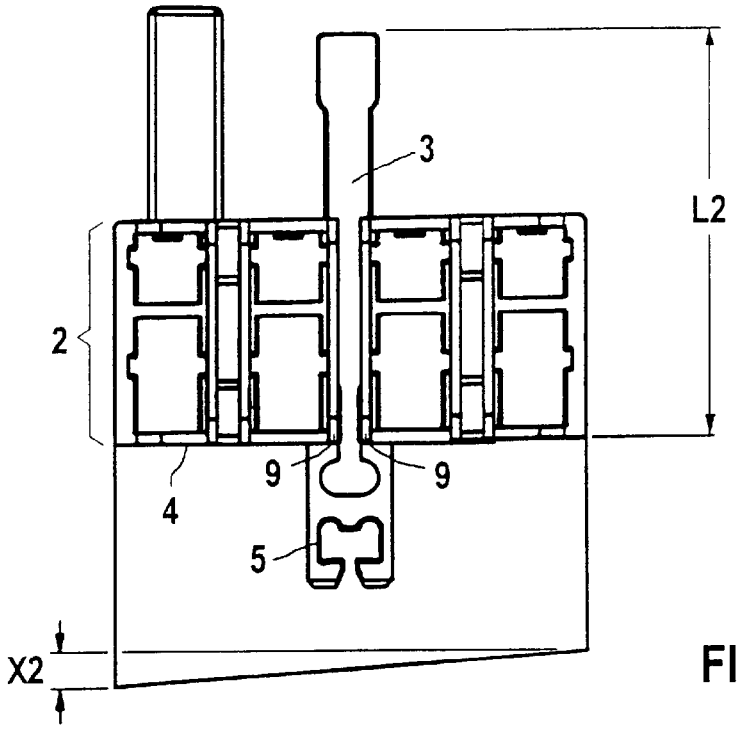
FIG. 1 shows a contact carrier of an auxiliary switch block.
Figure 2:
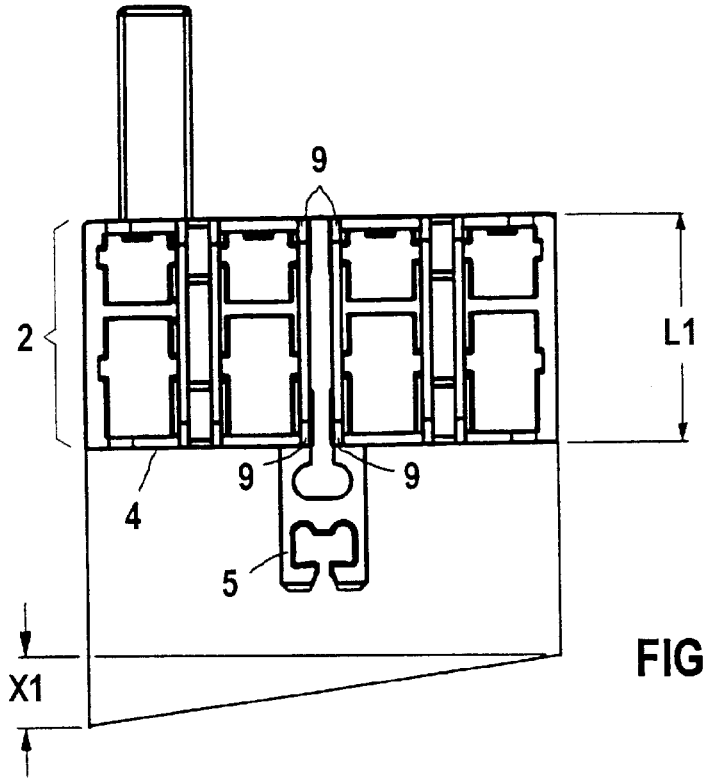
FIG. 2 shows a conventional contact carrier.
Figure 3:
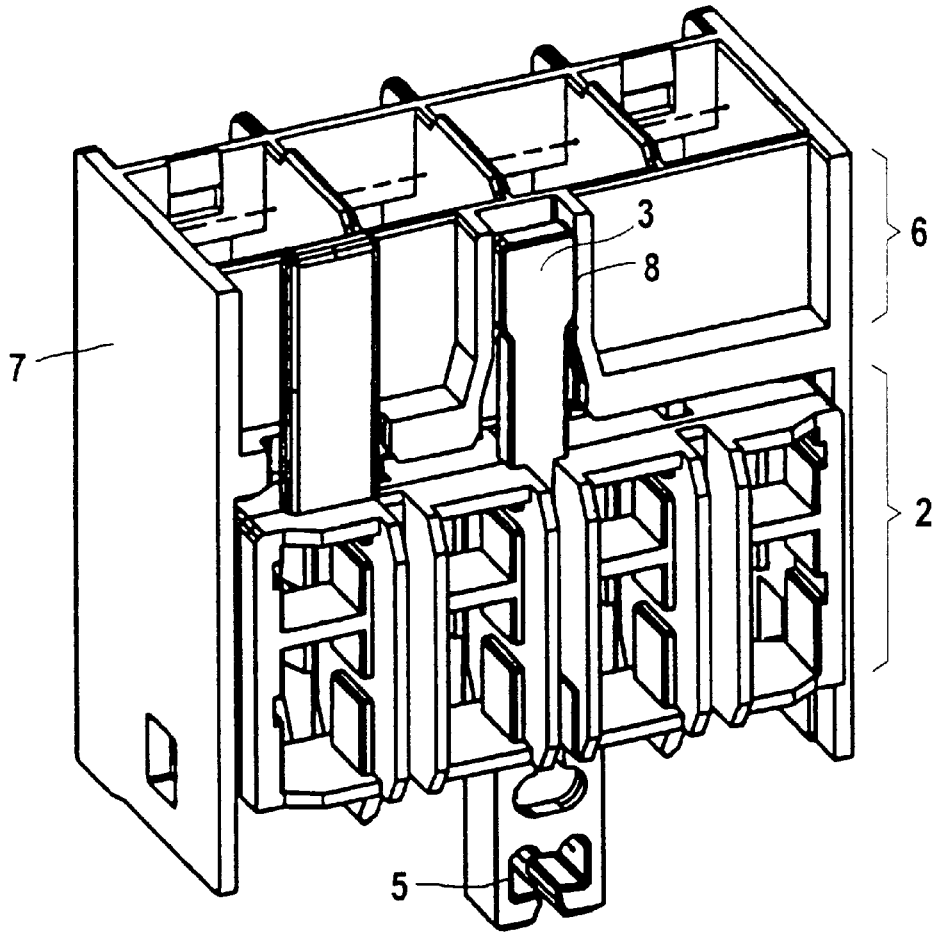
FIG. 3 shows an interrupter chamber.

FIG. 1 illustrates a contact carrier 2 for an auxiliary switch block (not illustrated here) which has points of contact 9 at the bottom. The coupling point 5, which is located on the attachment side 4 of the contact carrier 2, is used to engage with a contact carrier (not illustrated here) of a basic device. The contact carrier 2 has, at the top in FIG. 1, an elongate extension 3 which, according to FIG. 2, reaches into a region 6 of the interrupter chamber 7 and there engages with a groove 8 as guide means. The points of contact 9 on the attachment side 4 of the contact carrier 2, and the groove 8, are therefore used as a support. The two supports, according to FIG. 1, are spaced from each other at a distance L2. In comparison with the solution according to the prior art (see FIG. 3), where the distance L1 between the support is very much smaller, the result of this is a reduced oblique position, corresponding to the dimension X2, by comparison with the previous dimension X1. The dimension of the oblique position X2 is inversely proportional to the distance L2 between the lower point of contact 9 and the upper point of contact in the groove 8. The oblique position, which is reduced in this way, enables the forcible guidance to be maintained, because of the cooperation, described at the beginning, between the contact carrier 2 of the interrupter chamber 2 and the contact carrier of the basic device.

What is claimed is:

1. An auxiliary switch block for attachment to a device, comprising:

a guiding arrangement for guiding a first contact carrier in an interrupter chamber of the auxiliary switch block;

a coupling point arrangement positioned on a side of the first contact carrier for engaging a second contact carrier, the second contact carrier being a contact carrier of the device;

the first contact carrier including pairs of windows, a height of the first contact carrier corresponding to a height of the pairs of windows; and an extension arrangement positioned on the first contact carrier opposite to the coupling point arrangement, the extension arrangement extending over the height of the first contact carrier, reaching into a region of the interrupter chamber, projecting beyond the first contact carrier, and engaging with the guiding arrangement in the region of the interrupter chamber.

2. The auxiliary switch arrangement according to claim 1, wherein the guiding arrangement includes a groove in the interrupter chamber.

3. An arrangement for coupling a contact carrier of a device, comprising:

a first contact carrier including pairs of windows, a height of the first contact carrier corresponding to a height of the pairs of windows;

an interrupter chamber having a guiding arrangement guiding the first contact carrier;

a coupling point arrangement positioned on a side of the first contact carrier for engaging the contact carrier of the device; and an extension arrangement positioned on the first contact carrier opposite to the coupling point arrangement, the extension arrangement extending over the height of the first contact carrier, reaching into a region of the interrupter chamber, projecting beyond the first contact carrier, and engaging with the guiding arrangement in the region of the interrupter chamber.

4. The arrangement according to claim 2, wherein the guiding arrangement includes a groove in the interrupter chamber.

* * * * *